US007516634B1

(12) United States Patent
Golovashchenko et al.

(10) Patent No.: US 7,516,634 B1
(45) Date of Patent: Apr. 14, 2009

(54) ELECTROHYDRAULIC FORMING TOOL

(75) Inventors: Sergey Fedorovich Golovashchenko, Beverly Hills, MI (US); Alan John Gillard, Lincoln Park, MI (US); Dennis Allen Cedar, Rochester, MI (US); Andrey M. Ilinich, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/114,998

(22) Filed: May 5, 2008

(51) Int. Cl.
*B21D 26/08* (2006.01)
*B23P 19/00* (2006.01)

(52) U.S. Cl. ..... 72/54; 72/56; 72/707; 29/419.2; 29/802

(58) Field of Classification Search ..... 29/419.2, 29/802; 72/54, 56, 60, 63, 430, 707
See application file for complete search history.

(56) References Cited

U.S. PATENT DOCUMENTS

| | | | | |
|---|---|---|---|---|
| 3,222,902 | A * | 12/1965 | Brejcha et al. | 72/56 |
| 3,248,917 | A | 5/1966 | Herring, Jr. | |
| 3,267,710 | A * | 8/1966 | Inoue | 72/56 |
| 3,267,780 | A * | 8/1966 | Roth | 83/880 |
| 3,392,569 | A | 7/1968 | Smith | |
| 3,394,569 | A * | 7/1968 | Smith | 72/56 |
| 3,423,979 | A | 1/1969 | Smith et al. | |
| 3,486,062 | A | 12/1969 | Schrom | |
| 3,491,564 | A | 1/1970 | Hundley et al. | |
| 3,512,384 | A | 5/1970 | Inoue | |
| 3,553,434 | A | 1/1971 | Murray | |
| 3,559,435 | A | 2/1971 | Gerber | |
| 3,566,645 | A | 3/1971 | Lemelson | |
| 3,566,647 | A | 3/1971 | Inoue | |
| 3,566,648 | A | 3/1971 | Norin et al. | |
| 3,575,631 | A | 4/1971 | Pratt | |
| 3,591,760 | A | 7/1971 | Inoue | |
| 3,593,551 | A | 7/1971 | Roth | |
| 3,603,127 | A | 9/1971 | Seiffert et al. | |
| 3,742,746 | A * | 7/1973 | Erlandson | 72/56 |
| 3,814,892 | A | 6/1974 | Inoue | |
| 3,857,265 | A * | 12/1974 | Howeler et al. | 72/56 |
| 3,894,925 | A | 7/1975 | Inoue | |

(Continued)

FOREIGN PATENT DOCUMENTS

| | | |
|---|---|---|
| GB | 1068440 | 5/1967 |

(Continued)

OTHER PUBLICATIONS

"Optimization of Initial Blank Shape Predicted Based on Inverse Finite Element Method", Science Direct, Finite Elements in Analysis and Design 43 (2007), pp. 218-233.

(Continued)

*Primary Examiner*—David B Jones
(74) *Attorney, Agent, or Firm*—Raymond L. Coppiellie; Brooks Kushman P.C.

(57) ABSTRACT

An electrohydraulic forming (EHF) tool having a pair of electrodes that can be used to generate a shockwave to facilitate forming a sheet metal blank against a forming die. The electrodes may be adjusted during the course of operation. This may be useful should continued use cause their efficiency to drop below a desired threshold.

20 Claims, 5 Drawing Sheets

U.S. PATENT DOCUMENTS

| | | | | |
|---|---|---|---|---|
| 4,030,329 | A | 6/1977 | Chachin et al. | |
| 4,942,750 | A | 7/1990 | Conaway | |
| 3,232,086 | A | 2/1996 | Inoue | |
| 5,911,844 | A | 6/1999 | Benedyk | |
| 5,948,185 | A | 9/1999 | Krajewski et al. | |
| 6,033,499 | A | 3/2000 | Mitra | |
| 6,094,809 | A * | 8/2000 | Grassi | 29/802 |
| 6,215,734 | B1 | 4/2001 | Moeny et al. | |
| 6,227,023 | B1 * | 5/2001 | Daehn et al. | 72/57 |
| 6,349,467 | B1 | 2/2002 | Karafillis et al. | |
| 6,519,992 | B1 | 2/2003 | Schnupp | |
| 6,615,631 | B2 | 9/2003 | Kleber et al. | |
| 6,947,809 | B2 | 9/2005 | Ren et al. | |
| 7,130,708 | B2 | 10/2006 | Wang et al. | |
| 7,165,429 | B2 | 1/2007 | Steingroever | |
| 7,240,532 | B2 | 7/2007 | Zhang et al. | |
| 7,266,982 | B1 | 9/2007 | Guza | |
| 2005/0113722 | A1 | 5/2005 | Schultheiss | |
| 2005/0199032 | A1 | 9/2005 | Krajewski | |
| 2006/0201229 | A1 | 9/2006 | Zhu et al. | |

FOREIGN PATENT DOCUMENTS

| | | |
|---|---|---|
| GB | 1095276 | 12/1967 |
| GB | 1165902 | 10/1969 |
| GB | 1241343 | 8/1971 |
| GB | 1244922 | 9/1971 |
| GB | 1250901 | 10/1971 |
| GB | 1252997 | 11/1971 |
| GB | 1262072 | 2/1972 |
| GB | 1294240 | 10/1972 |
| RU | 2158644 | 11/2000 |

OTHER PUBLICATIONS

"General Motors' Quick Plastic Formng Process", James G. Schroth, TMS (The Minerals, Metals & Materials Society), 2004, pp. 99-20.

FY 2005 Progress Report, Automotive Lightweighting Materials, pp. 136-140.

"Demonstration of the Preform Anneal Process to Form a One-Piece Aluminum Door Inner Panel", Lee et al., SAE Technical Paper Series, No. 2006-01-0987, 2006 SAE World Congress, Detroit, MI, Apr. 3-6, 2006.

"Retrogression Heat Treatments in AA6111" Paul E. Krajewski, General Motors R&D Center, Materials and Processing Laboratory, Oct. 23, 2002.

"Metal Forming with Capacitor Discharge Electro-Spark", E.C. Schrom, Paper SP62-80, published in Advanced High Energy Rate Forming. Book II, ASTME, 1962.

"Research in Electric Discharge Forming Metals", R.L. Kegg et al., Paper SP62-78, published in Advanced High Energy Rate Forming, Book II, ASTME, 1962.

"Formability of Sheet Metal with Pulsed Electromagnetic and Electrohydraulic Technologies", S.F. Golovashchenko, et al., Proceedings of TMS Symposium "Aluminum-2003", San Diego, CA 2003.

"The Effect of Tool/Sheet Interaction in Damage Evolution of Electromagnetic Forming of Aluminum Alloy Sheet", J. Imbert et al, Transactions ASME, Journal of Engineering Materials and Technology, Jan. 2005, vol. 127, pp. 145-153.

"Equipment and Technological Processes with the Employment of Electrohydraulic Effect" G.A. Guliy, et al., Moscow: Mechanical Engineering, 1977.

"Electrohydraulic Effect and Some Potential Applications", L.A. Yutkin, St. Petersburg, 1959.

Concurred: Project Leader of MSTC Project N 1593—Mar. 31, 2003

"Technical Report on Scientific Research Project: Development of the Technology of Static-Electrohydropulsed Drawing on the Punch of Parts of Boxed Shape", Town of Sarov, 2003.

"Heat Treating, Cleaning and Finishing", Metals Handbook, 8th Ed., vol. 2, Amer.Soc.for Metals, pp. 277-278.

"Plants That Have Tough Metals and Large Parts To Form Watch Cautiously As. . . High Velocity Takes Off Again", J. E. Sandford, Iron Age Technical Features, Mar. 4, 1969, vol. 203, pp. 91-95.

* cited by examiner

ELECTROHYDRAULIC FORMING TOOL

TECHNICAL FIELD

The present invention relates to an electrohydraulic forming (EHF) tool.

BACKGROUND

Aluminum alloys and advanced high strength steels are becoming increasingly common as materials used in automotive body construction. One of the major barriers to wider implementation of these materials is their inherent lack of formability as compared to mild steels. Incorporating lightweight materials such as advanced high strength steels (AHSS) and aluminum alloys (AA) into high-volume automotive applications is critical to reducing vehicle weight, leading to improved fuel economy and reduced tailpipe emissions. Among the most significant barriers to the implementation of lightweight materials into high-volume production are stamping issues and the lack of intrinsic material formability in AHSS and AA.

Numerous stamping challenges are associated with the implementation of AHSS and AA in automotive production. The primary method of stamping body panels and structural parts is forming sheet material between a sequence of two sided dies installed in a transfer press or a line of presses. During the era of low oil prices, most automotive parts were stamped from Deep Drawing Quality (DDQ) steel or even Extra Deep Drawing Quality (EDDQ) steel, with both alloys exhibiting a maximum elongation in plane strain above 45%. The formability of aluminum alloys, on the other hand, typically does not exceed 25%. In practice, stamping engineers do not intend to form sheet metal beyond a level of 15% in plane strain due to the much lower work-hardening modulus of metals in these strain ranges, and also due to the danger of local dry conditions on the blank surface. The formability of AHSS is typically around 30%. Insufficient formability drives the necessity to weld difficult to form panels from several parts or to increase the thickness of the blank used in forming the panels.

Electrohydraulic forming (EHF) is a process which can significantly increase sheet metal formability by forming a sheet metal blank into a female die at high strain rates. The high strain rate is achieved by taking advantage of the electrohydraulic effect, which can be described as the rapid discharge of electric current between electrodes submerged in water and the propagation through the water of the resulting shockwave—a complex phenomenon related to the discharge of high voltage electricity through a liquid. The shockwave in the liquid, initiated by the expansion of the plasma channel formed between two electrodes upon discharge, is propagated towards the blank at high speed, and the mass and momentum of the water in the shockwave causes the blank to be deformed into an open die that has a forming surface. The shockwave forces the blank into engagement with the forming surface to form the metal blank into the desired shape.

DRAWINGS

The present invention is pointed out with particularity in the appended claims. However, other features of the present invention will become more apparent and the present invention will be best understood by referring to the following detailed description in conjunction with the accompany drawings in which:

FIG. 1 schematically illustrates an EHF process;

DESCRIPTION

Figure 1:
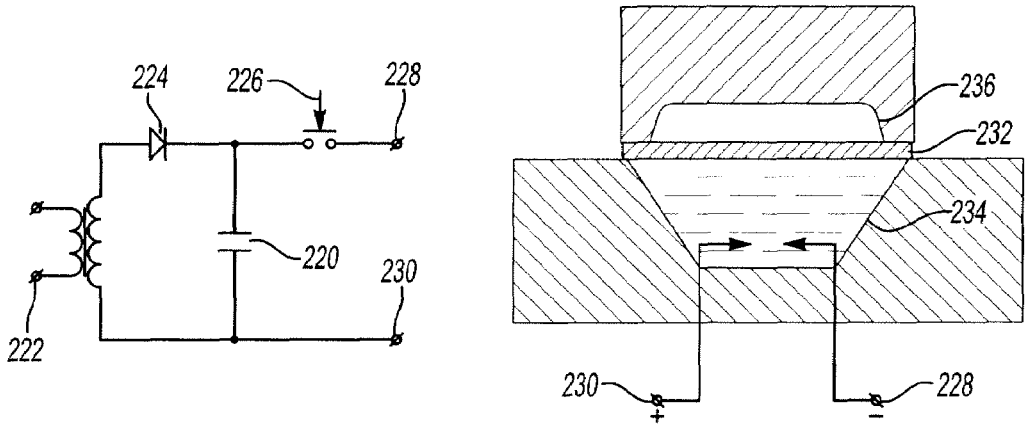

FIG. 1 schematically illustrates the EHF process. Electrical energy may be stored in high voltage capacitors 220 with the assistance of a transformer 222 and a set of diodes 224. A special switch or discharging device 226, such as an ignitron, vacuum discharger, or solid state switch, may be used to close the circuit and deliver high voltage stored in the capacitor 220 to electrodes 228, 230. The parameters which define the efficiency of the EHF process include the mutual position of the electrodes 228, 230, the electrical properties of the liquid, the charged voltage, the capacitance, the inductance and resistance of the equipment and connecting cables, the volume of the chamber, and the distance between the discharge channel and the blank.

At the beginning of the discharge process, the electrical resistance of a channel between the electrodes 228, 230 drops by several orders of magnitude, and the electric current sharply grows due to the increasing temperature and the expansion of the plasma channel. Due to the significant amount of electric energy pumped through the small, ionized channel, the temperature may increase, and the pressure inside the channel may grow during a short time interval. Driven by such high pressure, the discharge channel is quickly expanding and creates a shockwave.

For some parts, a blank 232 may be clamped between a chamber 234 and die cavity 236, which defines a forming surface 237 agent which the blank 232 is pressed during forming. However, in some cases, the outer edge of the part may have a three dimensional contour. A binder (not shown) having a corresponding shape can be employed to support the blank 232. In order to prevent a short circuit between the electrodes 228, 230 (which are usually made out of steel), they should be electrically insulated from the chamber 234, and the insulation material should be able to withstand the maximum voltage of the process. When it comes to inserting the electrodes 228, 230 into the chamber 234, proper hydraulic insulation should be provided to prevent leakage of water around the electrodes 228, 230. The chamber 234 should be properly sealed to avoid water leakage between the blank 232 and the chamber 234. Air between the blank 232 and the die 236 should be evacuated in order to avoid energy losses in the EHF process due to heating and compressing of the air during the forming step.

The repeated discharge of high-voltage electricity between the electrodes 228, 230 can cause the electrodes 228, 230 to gradually erode. This erosion can cause the distance between the electrodes 228, 230 to grow slowly over time, which can have a negative effect on the efficiency of the EHF process, if the electrodes 228, 230 are not adjusted and repositioned periodically. Due to the need to electrically insulate the electrodes 228, 230 from the EHF chamber 234, it can be difficult and cumbersome to adjust and reposition the electrodes 228, 230 in an attempt to regain the desired spacing and efficiency.

Figure 2:
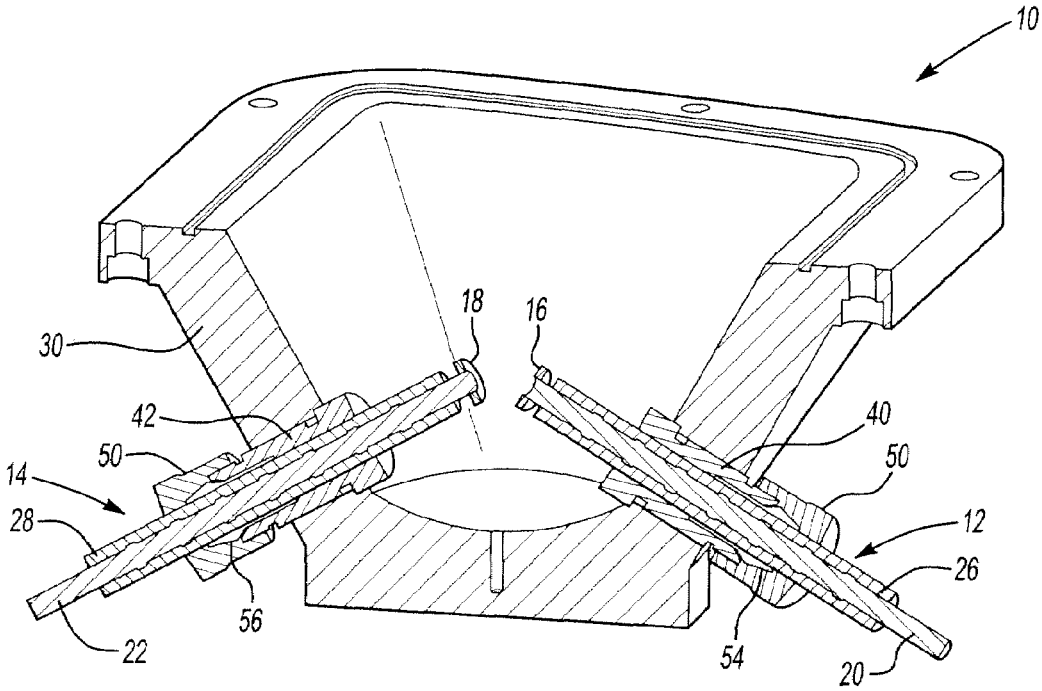
FIG. 2 illustrates an electrode configuration in accordance with one non-limiting aspect of the present invention.

FIG. 2 illustrates an electrode configuration 10 in accordance with one non-limiting aspect of the present invention. A pair of electrodes 12, 14 may include consumable electrode tips 16, 18 at a leading end of a body portion 20, 22. The tips 16, 18 can be replaced instead of replacing an entire solid rod forming the body portion 20, 22. The consumable electrode tips 16, 18 may be threaded or press fit to the electrodes 12, 14. A polyurethane insulation layer or other resilient material 26, 28 may be molded directly onto the body 20, 22. The body 20, 22 may include an undulating outer surface with successive sections having different diameters. Some or all of the diameters may be larger than a diameter of resilient element. The diameter conflict may be sufficient to force the resilient material 26, 28 to fill cavities within the undulated outer surface. This allows the resilient material to electrically isolate the electrode body 20, 22 and to limit liquid from leaking out of the chamber 30.

Figure 3:
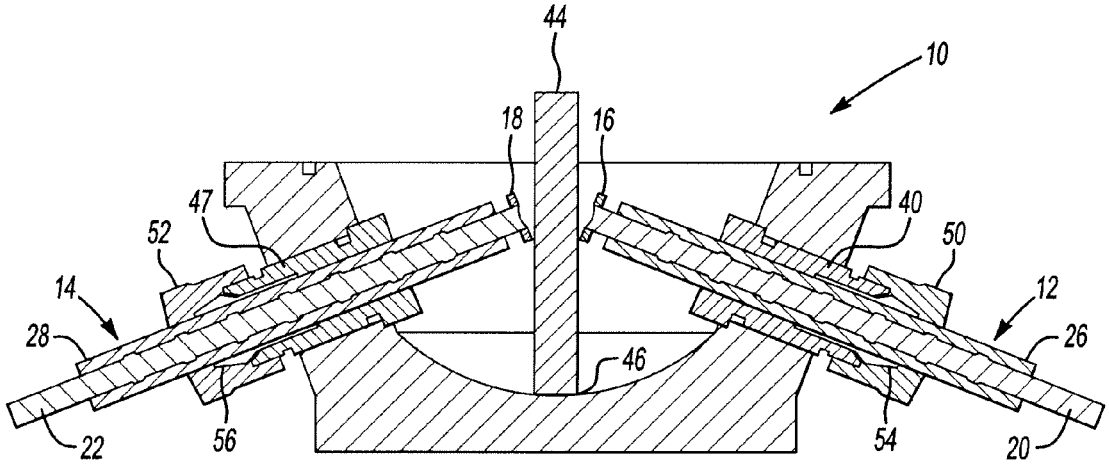
FIGS. 3-4 illustrate a spacer in accordance with one non-limiting aspect of the present invention.
Figure 4:
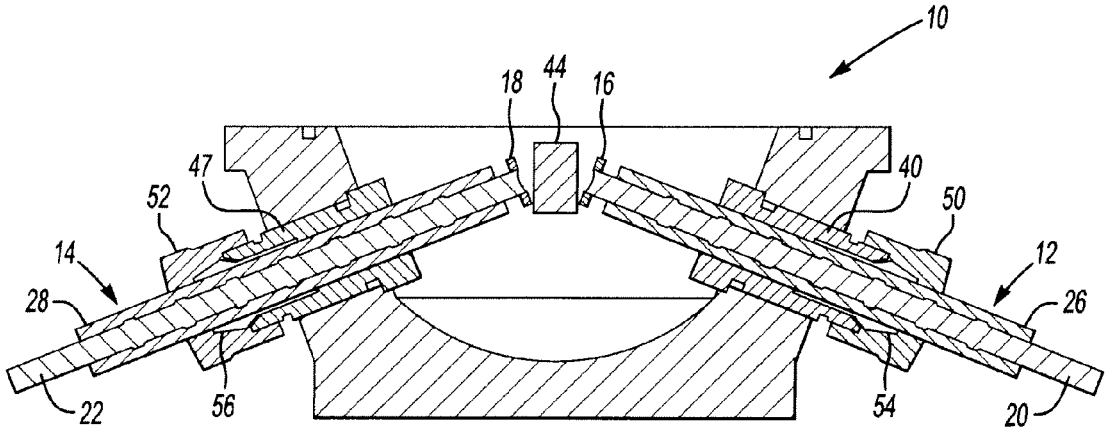

The press-fit nature of the resilient material 26, 28 allows the body 20, 22 to be easily inserted and extracted through an electrode shaft or collar 40, 42 attached to the chamber 30. Whenever the tip 16, 18 needs to be replaced, or whenever the inter-electrode distance needs to be adjusted, the electrode 12, 14 can be removed or advanced into the chamber 30. As shown in FIGS. 3-4, a spacer 44 can be positioned within the chamber 30 to facilitate advancing the electrodes 12, 14 to the desired position. FIG. 3 illustrates the spacer 44 being located within a relief or other fixture 46 in the chamber, and FIG. 4 illustrates the spacer 44 being robotically positioned with an arm of a robot (not shown).

Once the spacer 44 is positioned, the electrodes 12, 14 can be advanced into contact. If the spacer 44 is positioned at a location that is beneficial to the efficiency of the electrical discharge, the advancement of the electrodes 12, 14 in this manner allows the electrodes 12, 14 to be positioned at a desirable location relative to each other. The electrodes 12, 14 may be advanced manually and/or with a robot or other tool. The undulations on the electrodes 12, 14 and the press-fit between the resilient element 26, 28 and the collar 40, 42 may require a certain amount of force be overcome before the electrodes 12, 14 can be advanced. A nut 50, 52 and compression ring 54, 56 used to compress the resilient material 26, 28 to the electrode body 20, 22 and to seal the chamber 30, can influence the amount of force needed to position the electrodes 12, 14. The nut 50 may be loosened from its normally tightened state to reduce this pressure.

Figure 5:
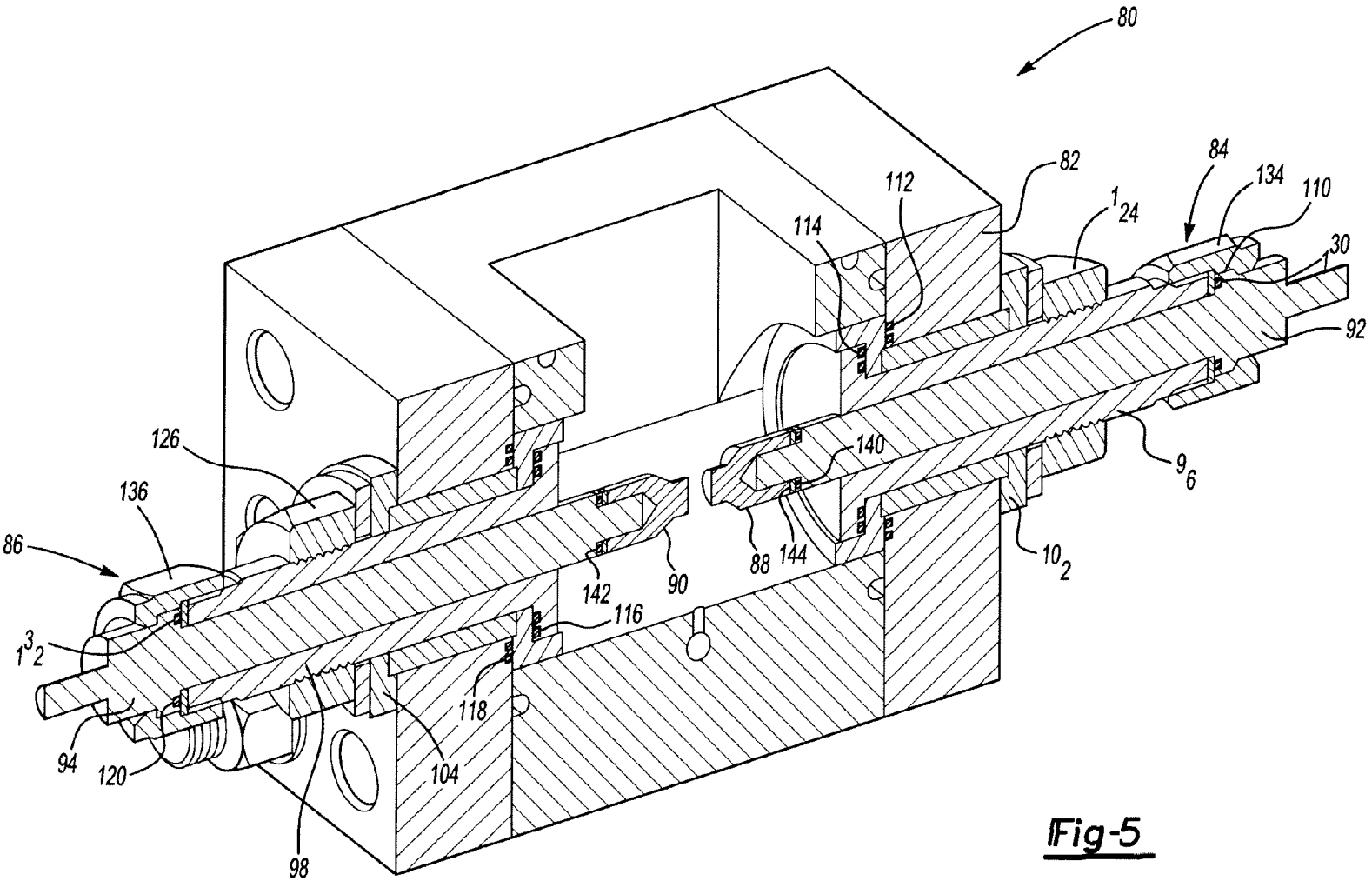
FIGS. 5-6 illustrate an electrode configuration in accordance with one non-limiting aspect of the present invention.
Figure 6:
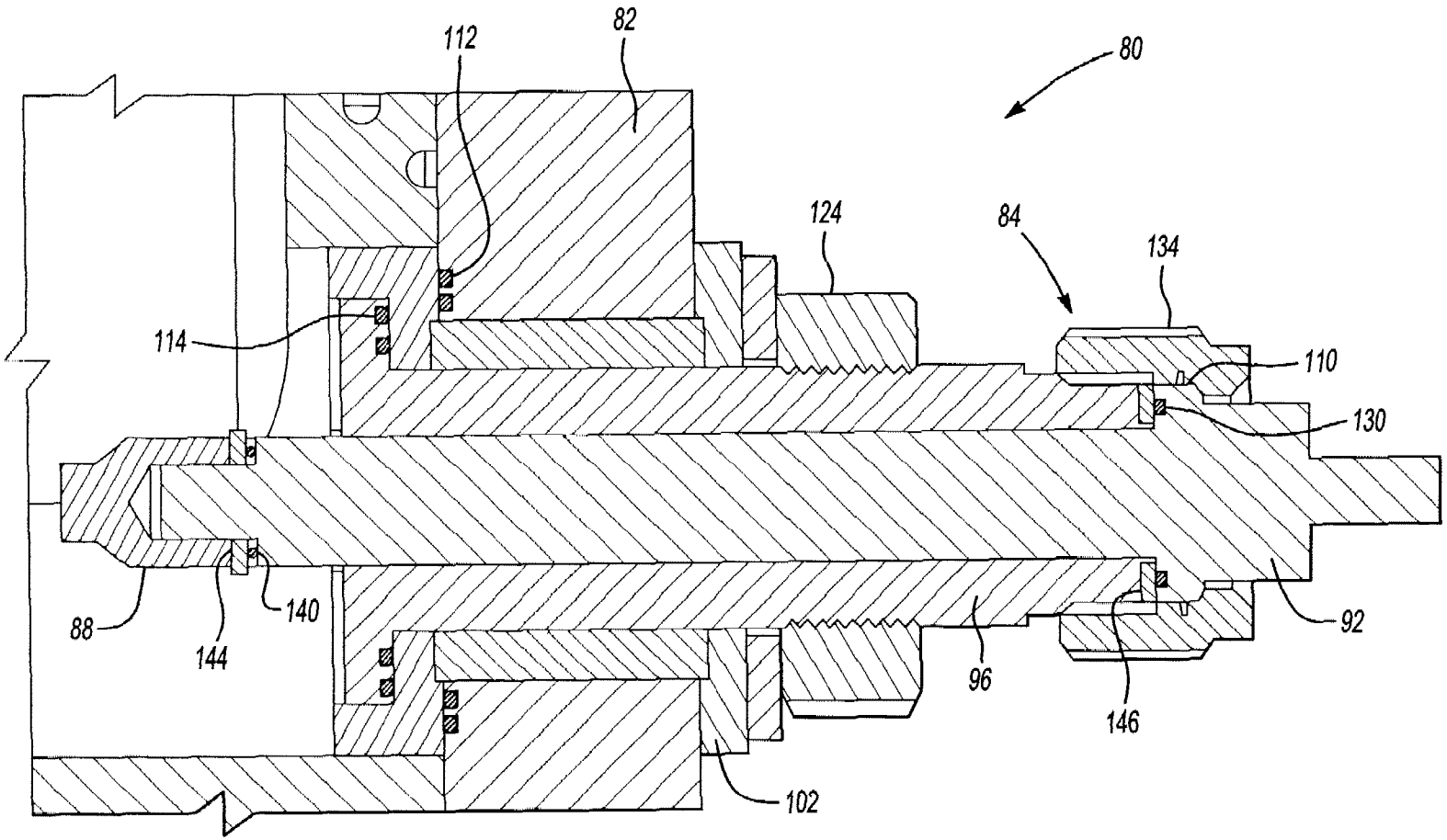

FIGS. 5-6 illustrate an electrode configuration 80 in accordance with one non-limiting aspect of the present invention. Unlike the chamber 30 shown in FIG. 2, a chamber 82 shown in FIG. 6 is not angled in an upwardly sloping direction. While neither FIG. 2 nor 6 illustrate a blank and forming die, but either would be positioned over top of the chamber 82 or over top of a binder (not shown) positioned on top of the chamber. A pair of electrodes 84, 86 having a tip 88, 90, body 92, 94, and shaft 96, 98 are positioned within side openings of the chamber 82. The electrodes 84, 86 may be operated to discharge a shockwave within liquid to form a blank in the manner described above.

A resilient element 102, 104 may be positioned within the openings to seal the shaft 96, 98 and limit liquid leakage. One or more seals 110, 112, 114, 116, 118, 120 may be strategically positioned between compression points to help prevent leakage. A chamber fastener 124, 126 may be press-fit, threadably secured, or otherwise fastened to a portion of the shaft 96, 98 and operatively connected to press a portion of the resilient material 102, 104 against an outside of the chamber 82 while securing a positioning on the shaft 96, 98 with respect to chamber 82. The outer diameter of the shaft 96, 98 may include features that limit a distance by which it can advance into the chamber 82. It may be advantageous to fix this distance, so that the shaft 96, 98 is positioned at the same location each time it is removed and subsequently inserted into the openings. This can be helpful in facilitating proper positioning of the electrodes 84, 86.

The proper positioning of the electrodes 84, 86 may be facilitated if the body 92, 94 is slidable moveable within the shaft 96, 98. Optionally, an outer diameter of the body 92, 94 may be less than an inner diameter of the shaft 96, 98 so that the body 92, 94 can be completely removed from the chamber 82 without having to unfasten the shaft 96, 98. An end of the body 92, 94 may be shaped to include a shoulder 130, 132 that extends above an end of the shaft 96, 98. A body fastener 134, 136 can be press-fit, threadably secured, or otherwise fastened over corresponding portions of the body 92, 94 and shaft 96, 98. The fastener 134, 136 may be tightened to press the shaft 92, 94 and body 96, 98 together. The seal 130, 132 may be positioned between the shaft 92, 94 and body 96, 98 to help prevent leakage.

The electrode tips 88, 90 may be press-fit, threadably secured, or otherwise fastened to a leading end of the body 92, 94. The body 92, 94 may include a shoulder portion 140, 142 against which the tip 88, 90 may be secured. The consumable tip 88, 90 may be discarded and replaced with a new tip should corrosion or properties of the tip 88, 90 degrade over time due to being continuously discharged within the liquid. The tips 88, 90 may be easily replaced by unfastening the body fastener 134, 136 and slidable removing the body 92, 94 through the shaft 96, 98.

FIG. 6 illustrate spacers 144, 146 that may be positioned between the body 92, 94 and shaft 96, 98 and/or the body 92, 94 and tip 88, 90. The spacers 144, 146 may be shaped to fit over the body 92, 94 and/or otherwise configured into some other type of shim. The object of the spacers 144, 146 is to offset the body 92, 94 and/or the tip 88, 90 from the non-offset positions shown in FIG. 6. This allows the present invention to initially position the electrodes 88, 90 and then to adjust their positioning simply by adding and/or removing the spacers 144, 146. While only a single spacer 144, 146 is shown to be included at each end of the body 92, 94, multiple spacers of any shape or thickness may be include at each end to facilitate positioning the electrodes 88, 90.

Figure 7:
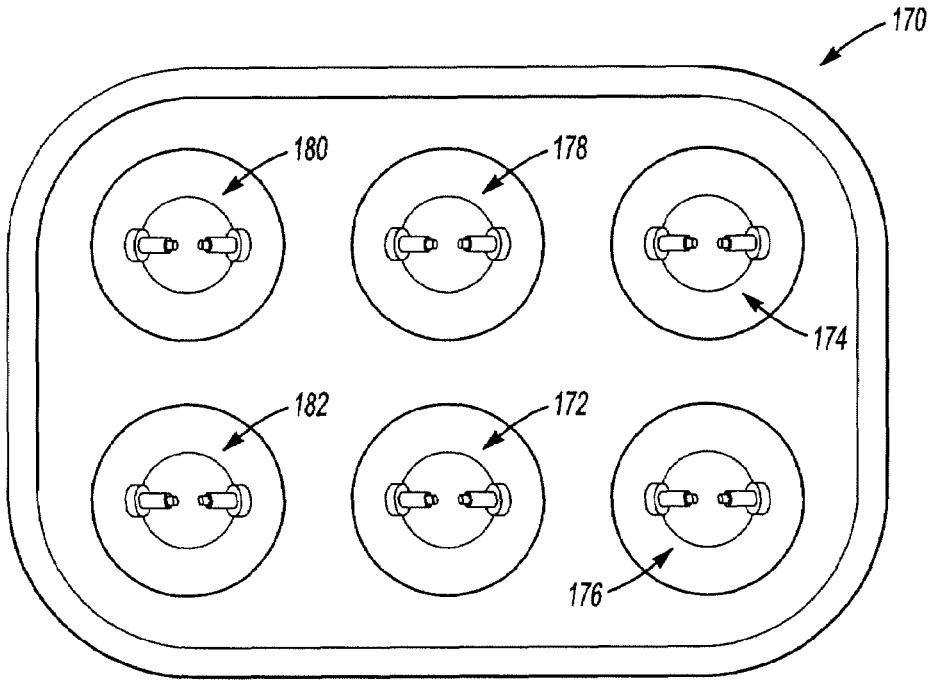
FIG. 7 illustrates a configuration for arranging and combining pairs of electrodes in accordance with one non-limiting aspect of the present invention.

FIG. 7 illustrates a configuration 170 for arranging and combining pairs of electrodes 172, 174, 176, 178, 180, 182. This arrangement essentially creates several small EHF chambers, each chamber complete with its own electrode pair. This arrangement could be attached to a single binder plate which would then serve as a large EHF chamber for forming large panels. Since the available forming pressure in a volume of water in the EHF process would decrease with increasing chamber volume, this reconfigurable and modular EHF arrangement allows for high forming pressures to be generated at all areas within the chamber volume. In addition to providing technical and physical advantages to the process, reconfigurable EHF chambers also present an opportunity for reducing capital costs spent on EHF tooling, since the same small chambers could be attached to many different binders and upper dies as necessary, i.e., multiple dies would be used with a single chamber at the same time. This allows for precise tailoring of the EHF process for a specific part, since certain parts may require more forming pressure in one area than in another.

Figure 8:
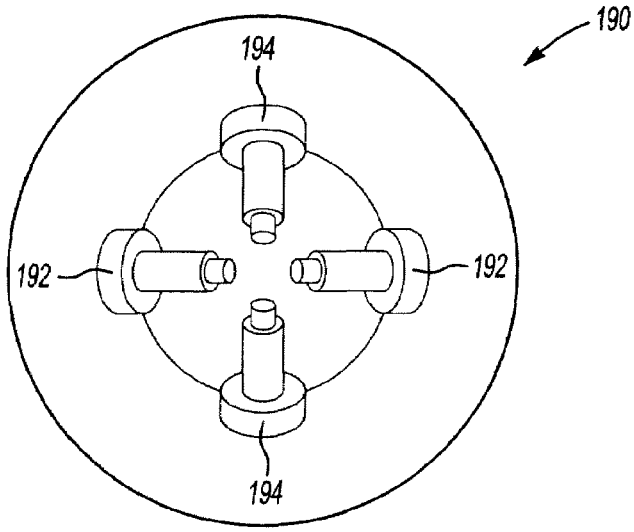
FIG. 8 illustrates a paired electrode system in accordance with one non-limiting aspect of the present invention.

FIG. 8 illustrates a paired electrode system 190 in accordance with one non-limiting aspect of the present invention. This system 190 includes a first and second set of electrodes 192, 194. Each set of electrodes 192, 194 may operate in the manner describe above. The sets 192, 194 are orthogonally positioned with respect to each other so that the resulting shockwave produces substantially the same result regardless of whether it originates with the first or second set of electrodes 192, 194. The positioning of each set of electrodes 192, 194 may be facilitated with the use of the above-described spacers.

Each set of electrodes 192, 194 may be positioned, so that either set 192, 194 can be used to form a blank (not shown). The present invention contemplates an arrangement when one set of electrodes 192 is used until their performance degrades below an acceptable threshold. Once this threshold is met, the electric discharge can be switched over to the other set of electrodes 194. This allows the present invention to switch the electrodes 192, 194 without having to service the degraded electrodes until a later time when it may be more convenient to open the die. While the switched-in electrodes 194 are in use, the degraded electrodes 192 may optionally be removed for servicing.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

What is claimed:

1. An electrohydraulic forming (EHF) method for forming a blank comprising:

after the blank is positioned above a vessel having liquid and below a forming die, generating an high voltage discharge between a pair of electrodes disposed within the liquid, the discharge generating a shockwave within the liquid that is sufficient to at least partially form the blank against the forming die;

repeatedly generating the high voltage discharge over time until properties of at least one of the electrodes begins to degrade to a point that an efficiency of the high voltage discharge drops below a desired threshold; and after the efficiency drops below the threshold, using a spacer to adjust at least one of the electrodes in a manner that increases the efficiency to a level above or at least equal to the desired threshold.

2. The method of claim 1 wherein adjusting the at least one of the electrodes includes inserting a spacer between the tip and a body of the electrode.

3. The method of claim 1 wherein adjusting the at least one of the electrodes includes inserting the spacer between an end of the electrode and a corresponding end of an electrode shaft used to cover at least a half of the electrode body.

4. The method of claim 1 wherein adjusting the at least one of the electrodes includes removing the at least one of the electrodes from the vessel and inserting the spacer between a tip and a body of the electrode or between an end of the electrode and a corresponding end of an electrode shaft and then re-inserting the electrode into the vessel.

5. The method of claim 1 wherein adjusting the at least one of the electrodes includes removing the at least one of the electrodes from the vessel and inserting the spacer between a tip and a body of the electrode, inserting another spacer between an end of the electrode and a corresponding end of an electrode shaft, and then re-inserting the electrode into the vessel.

6. The method of claim 1 wherein the spacer is located between a tip and a body of the electrode and adjusting the at least one of the electrodes includes removing the spacer.

7. The method of claim 1 wherein the spacer is inserted between an end of the electrode and a corresponding end of an electrode shaft used to cover at least a half of the electrode body and adjusting the at least one of the electrodes includes removing the spacer.

8. The method of claim 1 wherein adjusting the at least one of the electrodes includes positioning the spacer between the electrodes and advancing at least one of the electrodes farther into the vessel until the at least one advancing electrode contacts the spacer.

9. The method of claim 8 wherein positioning the spacer includes locating the spacer within a spacer relief cavity included within the vessel.

10. The method of claim 8 wherein positioning the spacer includes robotically suspending the spacer within the vessel.

11. An electrohydraulic forming (EHF) tool for forming a sheet metal blank comprising:

a vessel having liquid within a vessel cavity that opens at an upper end;

a forming die disposed above the upper end of the vessel, the forming die having a die cavity that is partially defined by a forming surface;

at least two electrodes disposed within the vessel cavity, each electrode having a tip, body, and shaft, the tip being releasably connected to a leading end of the body and the shaft covering at least a portion of the body; and at least one spacer positioned between the tip and the leading end of the body or between a trailing end of the body and the shaft.

12. The tool of claim 11 wherein the tip and body include corresponding threads and the spacer is shaped to fit over top of the threads and to compress between an end of the tip and a shoulder on the body if the spacer is positioned between the tip and body and threadably tightened.

13. The tool of claim 11 wherein the body is slidable removable from the shaft and the spacer is shaped to fit over top of the body and to compress between an end of the shaft and a shoulder on the body if the spacer is positioned between the shaft and body and pressed together.

14. The tool of claim 11 further comprising a shaft fastener that is shaped to commonly engage corresponding portions of the shaft and body and to press the shaft and body together.

15. An electrohydraulic forming (EHF) tool for forming a sheet metal blank comprising:

a vessel having liquid within a vessel cavity that opens at an upper end;

a forming die disposed above the upper end of the vessel;

at least two openings into to the vessel cavity, each side opening being covered with a resilient material used to limit liquid from leaking out of the vessel cavity;

an electrode positioned within each of the openings, each electrode having an undulating outer surface in engagement with the resilient material.

16. The tool of claim 15 wherein at least a portion of the outer surface is larger than a diameter of the resilient material.

17. The tool of claim 15 wherein the undulating outer surface is characterized by at least a substantial portion of the electrode having successive sections with diameters that are different from the adjoining sections.

18. The tool of claim 15 wherein at least two pairs of electrodes are positioned within the vessel cavity.

19. The tool of claim 18 wherein each pair of electrodes has a removable spacer.

20. An electrohydraulic forming (EHF) tool for forming a sheet metal blank comprising:

a vessel having liquid within a vessel cavity that opens at an upper end;

a forming die disposed above the upper end of the vessel, the forming die having a die cavity that is partially defined by a forming surface; and at least two different pairs of electrodes disposed within the vessel cavity, wherein the electrode pairs are orthogonal to each other.

* * * * *